United States Patent [19]

Hermans

[11] 4,328,955

[45] May 11, 1982

[54] DEFENSIVE PERSONNEL BARRIER

[76] Inventor: Albert L. Hermans, 2251 Bancroft Ave., San Leandro, Calif. 94577

[21] Appl. No.: 129,274

[22] Filed: Mar. 10, 1980

[51] Int. Cl.[3] ..... B21F 25/00; E04H 17/04

[52] U.S. Cl. ..... 256/8; 256/47; 256/55; 140/58; 140/66; 29/7.1

[58] Field of Search ..... 256/2–9, 256/55, 47; 140/58, 66; 29/7.1

[56] References Cited

U.S. PATENT DOCUMENTS

| | | | |
|---|---|---|---|
| 244,274 | 7/1881 | Marshall | 256/9 |
| 303,625 | 8/1884 | Crump | 256/55 |
| 324,221 | 8/1885 | Brinkerhoff | 256/6 X |
| 1,187,280 | 6/1916 | Dodds | 256/55 |
| 2,940,732 | 6/1960 | MacChesney et al. | 256/8 |
| 2,948,049 | 8/1960 | Wilson | 140/58 X |
| 3,463,455 | 8/1969 | Meckel | 256/8 |
| 3,480,256 | 11/1969 | Simon et al. | 256/8 |

FOREIGN PATENT DOCUMENTS

| | | | |
|---|---|---|---|
| 122544 | 11/1946 | Australia | 256/47 |
| 72789 | 11/1916 | Switzerland | 256/8 |
| 14196 | of 1895 | United Kingdom | 256/55 |
| 12060 | of 1915 | United Kingdom | 256/7 |

*Primary Examiner*—James Kee Chi

*Attorney, Agent, or Firm*—Harris Zimmerman; Howard Cohen

[57] ABSTRACT

A defensive personnel barrier and method for fabrication thereof includes an elongated metal strip having a longitudinally extending bend therein to form a spine extending therealong with laterally opposed flanges extending obliquely from the spine. Each flange is stamped or die cut to provide a plurality of cuts spaced therealong and extending diagonally from the spine to the outer edge of the flange. The diagonally cut portions are bent upwardly from the plane of the flange to form a plurality of barbs spaced longitudinally in the metal strip. The barbs of the opposed flanges are staggered longitudinally, and the edges of the barbs are sufficiently sharp to discourage manual grasping of the strip. One or more strips may be secured atop a fence or similar barrier to discourage climbing thereon. The barrier strips may also be secured to existing linear barbed wire strands by means of a saddle block and J bracket assembly provided by the invention.

8 Claims, 11 Drawing Figures

DEFENSIVE PERSONNEL BARRIER

BACKGROUND OF THE INVENTION

Although barbed wire was originally devised as a fencing material to control grazing livestock, it has also come into commonplace use as a defensive security barrier to inhibit human intrusion. Typically, the barbed wire is strung atop a fence or wall on obliquely upstanding outriggers to discourage people from climbing over the fence or wall. The barbed wire may also be secured in helical loop fashion atop a fence or wall for the same purpose.

The use of barbed wire in such a manner is a psychological barrier as much as physical barrier, due to the fact that there are many ways to circumvent the barbed wire barrier. For example, the wire easily may be cut by manual tools, or the wire may be covered with a heavy blanket, a piece of wood, or the like, to neutralize the barbs and provide access thereover. Furthermore, the outriggers which support the barbed wire strands may actually encourage breachment of the wall or fence by providing handholds at the top of the wall or fence for the person attempting to climb thereover.

In more recent years, there have been developed other materials to overcome the deficiencies of barbed wire noted above. These materials and devices generally comprise elongated metal strips having sharpened edges and/or sharpened barbs extending outwardly therefrom. Generally speaking, these metal strips are formed in helical loops and are placed atop a fence or wall. Although these materials are more effective than barbed wire, they are also extremely expensive to manufacture, due to the greater amount of material used in the metal strip, and also due to the helical loop configuration of the metal strip. Also, these prior art materials have been shown by experience to be extremely difficult to manipulate and to install, due to the sharp edges and sharpened barbs. Also, these devices have exhibited difficulty in installation due to the barbs and their tendency to become entangled. The entanglement of the prior art material is further exacerbated by longitudinally extending wire elements which are secured to adjacent helical loops to prevent spreading thereof. A prior art patent which discloses a typical material is U.S. Pat. No. 3,463,455, issued on Aug. 26, 1969.

SUMMARY OF THE PRESENT INVENTION

The present invention generally comprises a defensive security barrier material and method for fabrication thereof which is designed to overcome the deficiencies of barbed wire and the like noted in the foregoing background of the invention. The present invention is particularly adapted to discourage unauthorized intrusion over a fence or wall, and to prevent tampering with the material and breachment thereof.

The barrier material of the present invention includes an elongated strip of corrosion resistant, shiny metal. The strip is provided with a bend extending longitudinally therein to form a spine extending therealong with laterally opposed flanges extending from the spine. The flanges are provided with diagonal cuts formed therein and extending from the outer edge thereof almost to the spine of the metal strip. The diagonal cuts define a plurality of longitudinally spaced barbs, the barbs being bent upwardly out of the plane of the flange. The spaced barbs extending upwardly from the strip present a phalanx of sharp points and sharp edges which discourage any manual tampering with the strip. The strip may be secured to existing barbed wire strands atop a fence or wall, or may be supported atop a fence or wall by upwardly extending support members. The invention includes a saddle and mounting bracket for securing the strip to existing barbed wire strands.

A BRIEF DESCRIPTION OF THE DRAWING

DESCRIPTION OF THE PREFERRED EMBODIMENT

The present invention includes a defensive security barrier designed to discourage and prevent unauthorized intrusion. The invention also includes the material which is used to form the defensive security barrier, as well as a method of fabricating the defensive security material.

Figure 1:
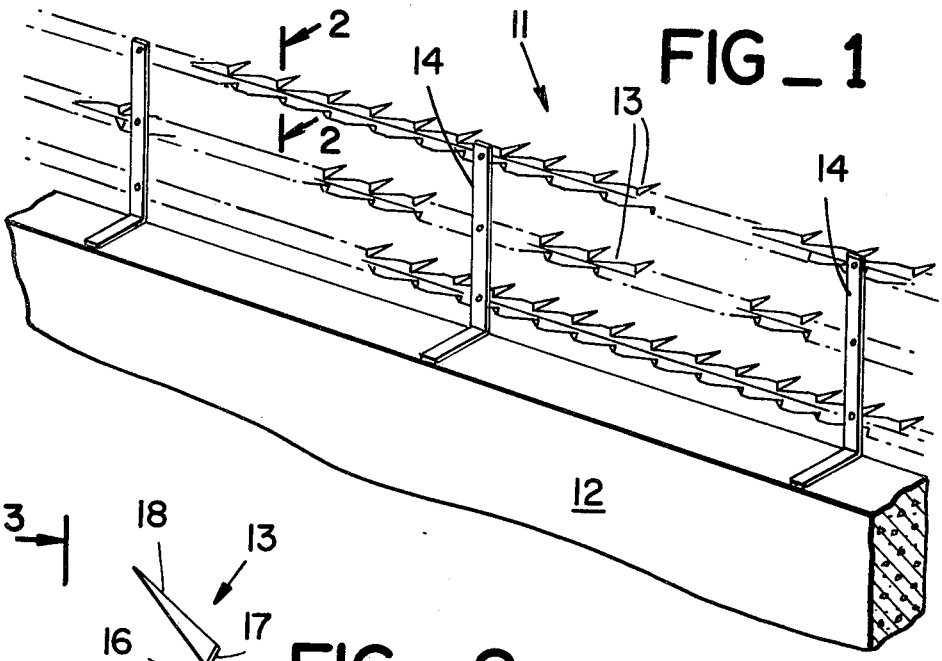
FIG. 1 is a perspective view of the defensive security barrier material of the present invention.

With reference to FIG. 1, the defensive security barrier 11 of the present invention is disposed atop a wall 12 to prevent intrusion over the wall. The barrier 11 includes a plurality of horizontally extending metal strips or ribbons 13. The strips 13 are spaced vertically each from the other and are provided with a plurality of barbs or prongs extending outwardly from the barrier 11. The barbs or prongs are spaced along the strips 13, and present to a would-be intruder a phalanx of sharp points and sharp edges which form a psychological as well as physical barrier to intrusion over the wall 12. A plurality of wall mounting brackets 14 extend upwardly from the top surface of the wall 12 and are spaced therealong. The strips 13 are secured to the brackets 14 and supported thereby.

Figure 2:
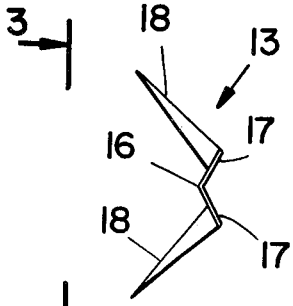
FIG. 2 is an end view of the barrier material of the present invention.
Figure 3:
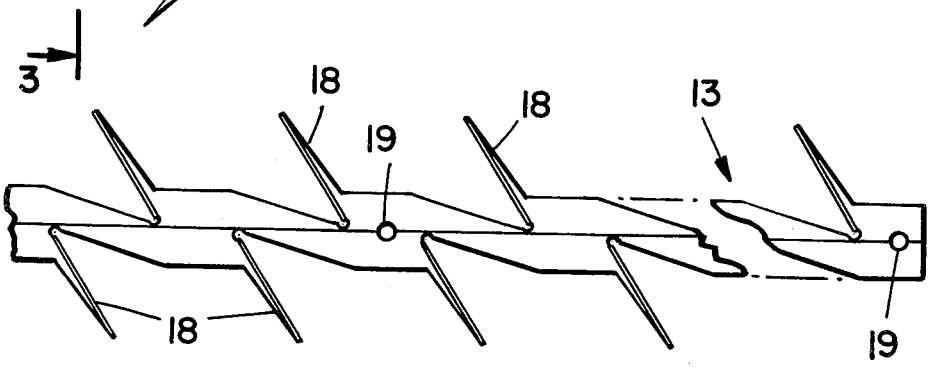
FIG. 3 is a top view of the barrier material of the present invention, taken along line 3—3 of FIG. 2.
Figure 4:
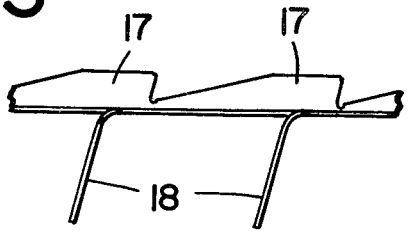
FIG. 4 is a side view of the barrier material of the present invention.

With reference to FIGS. 2, 3, and 4, the metal strips or ribbons 13 each comprise a longitudinally extending metal strip having a longitudinally extending bend 16 therein which forms a spine extending along the strip to provide the strip with stiffness and rigidity. The longitudinal bend forming the spine 16 defines a pair of laterally opposed flanges 17 extending from the spine. In the preferred embodiment, the flanges 17 define an included angle of approximately 120°.

Extending upwardly from each of the flanges 17 is a plurality of prongs or barbs 18. Each of the barbs 18 comprises a narrow, highly tapered portion of the respective flange 17, the tapered portion being bent upwardly from the plane of the respective flange approximately 75°. As shown in FIG. 3, the barbs 18 are spaced longitudinally along the strip 13, with the barbs of each flange being alternately spaced with the barbs of the opposed flange. As shown in FIG. 2, the barbs 18 are all directed in the same general direction; i.e., away from the 120° included angle of the flanges 17. The strips 13 are oriented so that the barbs 18 point outwardly toward the direction of expected intrusion. In the barrier shown in FIG. 1, all of the barbs 18 point outwardly to present a phalanx of sharpened points and sharp edges to intimidate and repell an intruder.

In the preferred embodiment the metal strip 13 is formed of hardened stainless steel which is provided with a highly reflective surface treatment. The surfaces of the flanges 17 and the barbs 18 thus are very reflective, and present a jagged, striking image both in natural lighting conditions and in artificial lighting conditions.

As shown in FIG. 3, the strip 13 of the present invention may be provided with a plurality of mounting holes 19 spaced longitudinally therealong. The mounting holes 19 extend through the spine 16, and are equally spaced along the strip to facilitate mounting thereof to support brackets and the like, as will be described in the following.

Figure 5:
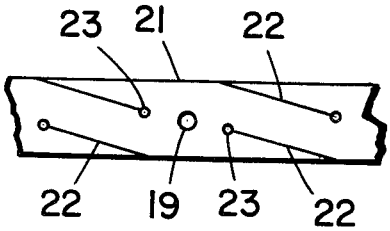
FIG. 5 is a top view of the barrier strip of the present invention, shown partly formed with the diagonal cuts formed therein and prior to the barbs being bent outwardly therefrom.

The strip 13 of the present invention is formed from a narrow elongated web of a strong, durable metal, such as hardened stainless steel which is provided with a bright electro-finish. The metal web 21, shown in FIG. 5, is then stamped or die cut to form a plurality of diagonal cuts 22, each extending from an outer edge of the web to stress relief hole 23 which is disposed adjacent to the longitudinal center line of the web 21. It may be noted that the diagonal cuts 22 are in opposed, paired relationship, and that the stress relief holes 23 are in alternating relationship along the longitudinal extent of the web 21. The web 21 is also provided with a bend extending longitudinally therein to form the spine 16 which is shown in FIG. 2. The longitudinal bend which forms the spine 16 may be formed in the web 21 either prior to or subsequent to the formation of the cuts 22 and the stress relief holes 23. The mounting holes 19 may be formed in the web 21 during the same stamping or die cutting operation which forms the diagonal cuts and the stress relief holes.

The last step in the fabrication of the barrier strips 13 is the formation of the barbs 18. The barbs are created by bending the narrow, tapered portion formed by the diagonal cut 22, the tapered portion being bent upwardly along a line extending from the respective stress relief hole 23 to the adjacent outer edge of the web. The narrow tapered portion is bent upwardly approximately 75° from the plane of the flange 17 from which it extends. In the preferred embodiment the barbs 18 are spaced approximately 2.5 inches (6.25 centimeters), and each barb is approximately 1.8 inches (4.75 centimeters) in length. The strips 13 may be fabricated in discrete lengths, or may be fabricated in large rolls suitable for installations requiring a large amount of the material.

A salient feature of the present invention is that the defensive security barrier strips 13 may be secured to existing barbed wire strands which are typically secured in linear fashion atop in existing fence or wall. The barrier strips 13 thus serve to augment the security effect of existing barbed wire while relying on the existing strands of barbed wire for support.

Figure 6:
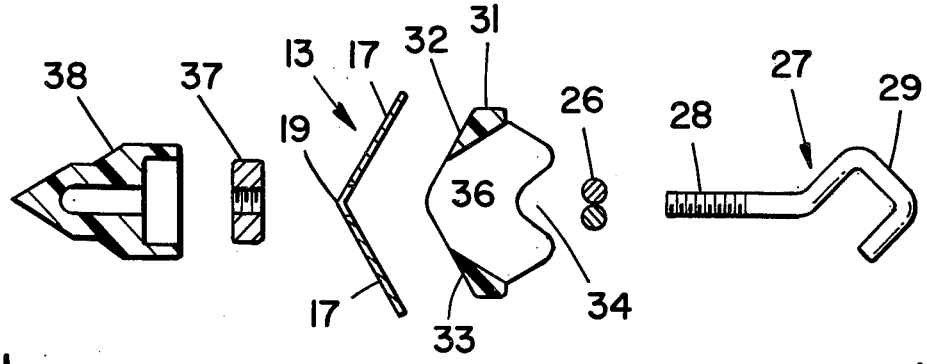
FIG. 6 is an exploded view of a mounting bracket of the present invention for securing the defensive security strip of the present invention to existing barbed wire strands.

With reference to FIG. 6, the invention includes a bracket assembly which clamps the barrier strip 13 to an existing linear barbed wire strand 26. The bracket assembly includes a J-bracket 27 having a threaded shank 28 and a hook end 29 extending therefrom. The bracket assembly also includes a mounting block 31 which is provided with two planar surfaces 32 and 33 extending at an angle which is equal to the included angle of the flanges 17. The block 31 is thus adapted to impinge upon the strip 13 in mating relationship therewith.

Figure 7:
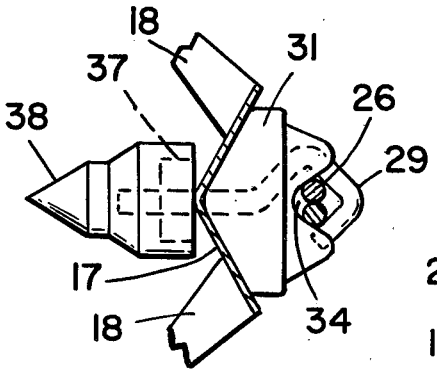
FIG. 7 is a side view showing the bracket of FIG. 6 joining the strip of the present invention to a barbed wire strand.
Figure 8:
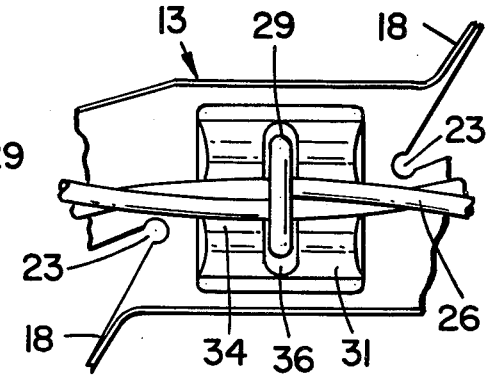
FIG. 8 is a bottom view of the bracket of the present invention as shown in FIG. 7.
Figure 11:
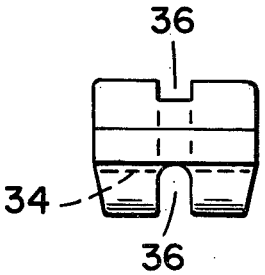
FIG. 11 is an end view of the mounting block shown in FIG. 9.

The mounting block 31 is also provided with a groove 34 extending longitudinally therein and adapted to receive the barbed wire strand (twisted pair) 26 therein. This is shown clearly in FIGS. 7 and 8. The mounting block 31 is provided with a slot 36 which extends through the block perpendicular to the groove 34, as shown in FIG. 11. The shank 28 of the bracket 27 is adapted to extend through the slot 36 and through the mounting hole 19 of the strip 13, with the hook portion 29 engaging the barbed wire strand 26 and retaining it in the groove 34, as shown in FIG. 7. A nut 37 is secured to the threaded shank 28 on the opposed side of the strip 13 to retain the assembly together compressively. A cap 38 may be secured to the distal end of the shank 28 and to the nut 37 to protect these parts from tampering. To augment the protective aspect of the cap 38, the cap may be secured to the shank 28 and the nut 37 by means of epoxy or similar adhesive.

Figure 9:
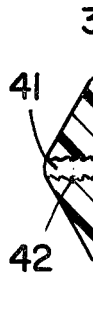
FIG. 9 is a cross-sectional side view of the mounting block of the assembly shown in FIG. 6.
Figure 10:
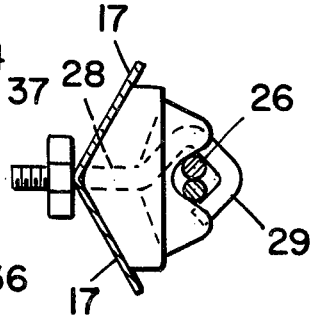
FIG. 10 is a further embodiment of the mounting bracket shown in FIG. 6.

In a further embodiment of the invention, shown in FIGS. 9 and 10, the mounting block 31 includes the same groove 34 to receive and secure the barbed wire strand 26. The slot 36, however, is much shallower, and does not extend through the entire mounting block. Rather, a hole 41 extends through the mounting block from the apex thereof to the inner extent of the slot 36. The hole 41 is provided with a plurality of annular, tooth-like ribs 42, the points of the tooth-like annular projections extending toward the apex opening of the hole 41. The hook portion 29 of the bracket 27 engages the barbed wire strand 26, and the shank 28 is inserted through the slot 36 and the hole 41. The tooth-like annular ribs 42 engage the threaded portion of the shank 28 in unidirectional fashion, permitting the shank to be inserted in the hole 41 but preventing removal of the shank therefrom. The tooth-like ribs 42 may be relied upon to maintain the cooperative engagement of the hook 29 and the barbed wire 26 in the groove 34. The threaded shank 28 may then be inserted through the hole 19 in the strip 13, and the nut 37 is secured to the threaded shank 28 to retain the entire assembly compressively together. In this embodiment the cap 38 may also be used, if desired, to further prevent tampering with the mounting arrangement.

With reference to FIG. 3, it should be noted that all of the die cut edges of the barrier strip 13 are sufficiently sharp to inflict injury on an intruder. Thus not only are the barbs 18 a formidable obstacle, but also the laterally extending edges of the strip 13 from which the barbs are cut. Close spacing of two or more strips 13 provides less than sufficient clearance for any manual activity therebetween, and thus strongly deters any attempt to tamper with the security barrier material 13. The barrier 11 may be secured atop any form of wall construction, such as concrete, stone, or the like, or may be secured atop any fence construction, such as chain-link fence, wooden fence, or the like.

I claim:

1. A defensive security barrier device, comprising a narrow, longitudinally extending web having laterally opposed edges, a plurality of parallel diagonal cuts spaced longitudinally along said web and extending from said edges toward the centerline of said web, a medial bend extending longitudinally in said web to define a longitudinally extending stiffening spine and a pair of laterally opposed flanges extending directly therefrom at an oblique angle, said lateral edges generally extending in a common plane, said diagonal cuts defining a plurality of acute angle portions being bent out of their respective flanges to form a plurality of barbs, said barbs extending outwardly from said common plane in the same general direction.

2. The defensive barrier device of claim 1, further including a plurality of stress relief holes, each disposed at the interior end of one of said diagonal cuts.

3. The defensive barrier device of claim 1. further including a plurality of mounting holes spaced along said web and extending through said spine thereof.

4. The defensive barrier device of claim 1, further including means for securing said device to an existing linear wire strand.

5. The defensive barrier device of claim 4, wherein said means includes a mounting block having a groove therein to receive said wire strand, and a pair of adjacent surfaces disposed at the same angle as said included angle of said flanges and adapted to impinge thereon.

6. The defensive barrier device of claim 5, wherein said mounting block includes a slot extending therethrough transverse to said groove, and further including a J bracket having a shank end extending through said slot and a hook end which engages and retains said wire strand.

7. The defensive barrier device of claim 6, wherein said slot includes means therein for retaining said shank end of said J-bracket.

8. The defensive barrier device of claim 6, wherein said shank end extends through said device and is secured thereto to assemble said device to said wire strand.

* * * * *